US011107618B2

(12) United States Patent
Shirouzu

(10) Patent No.: US 11,107,618 B2
(45) Date of Patent: Aug. 31, 2021

(54) CORE BODY AND REACTOR

(71) Applicant: FANUC CORPORATION, Yamanashi (JP)

(72) Inventor: Masatomo Shirouzu, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 16/879,959

(22) Filed: May 21, 2020

(65) Prior Publication Data

US 2020/0286669 A1 Sep. 10, 2020

Related U.S. Application Data

(63) Continuation of application No. 16/017,191, filed on Jun. 25, 2018, now Pat. No. 10,734,154.

(30) Foreign Application Priority Data

Jul. 4, 2017 (JP) ..... JP2017-131377

(51) Int. Cl.

| | |
|---|---|
| ***H01F 30/12*** | (2006.01) |
| ***H01F 27/26*** | (2006.01) |
| ***H01F 27/28*** | (2006.01) |
| ***H01F 27/25*** | (2006.01) |
| ***H01F 27/245*** | (2006.01) |
| ***H01F 3/14*** | (2006.01) |

(52) U.S. Cl.

CPC ..... *H01F 27/263* (2013.01); *H01F 3/14* (2013.01); *H01F 27/245* (2013.01); *H01F 27/2455* (2013.01); *H01F 27/25* (2013.01); *H01F 27/28* (2013.01)

(58) Field of Classification Search

CPC ..... H01F 3/12
USPC ..... 336/5
See application file for complete search history.

(56) References Cited

U.S. PATENT DOCUMENTS

| | | | | |
|---|---|---|---|---|
| 2,616,070 A | 10/1952 | Corbino | | |
| 2,702,887 A | 2/1955 | Joublanc | | |
| 4,085,603 A * | 4/1978 | Vanek | H01F 27/25 29/605 |
| 2006/0087393 A1 | 4/2006 | Dahlgren et al. | | |
| 2017/0011842 A1* | 1/2017 | Ishigaki | H02M 3/33576 |

(Continued)

FOREIGN PATENT DOCUMENTS

| | | |
|---|---|---|
| CN | 103730243 A | 4/2014 |
| CN | 103745815 A | 4/2014 |

(Continued)

OTHER PUBLICATIONS

Entire patent prosecution history of U.S. Appl. No. 16/017,191, filed Jun. 25, 2018, entitled, "Core Body and Reactor."

*Primary Examiner* — Ronald Hinson
(74) *Attorney, Agent, or Firm* — RatnerPrestia

(57) ABSTRACT

A core body includes a central iron core, an outer peripheral iron core surrounding the central iron core, and a single hoop material wound body formed by winding a hoop material. At least three iron portions of an outer circumferential surface of the hoop material wound body are bent radially inward thereof. The central iron core includes at least three iron cores, each of which having a cut tip, is made by cutting at least three projection portions of the hoop material wound body. Each of the at least three projection portions is located between the at least three portions.

5 Claims, 11 Drawing Sheets

(56) References Cited

U.S. PATENT DOCUMENTS

| | | | |
|---|---|---|---|
| 2017/0040099 | A1 | 2/2017 | Bhide et al. |
| 2017/0084377 | A1 | 3/2017 | Maeda et al. |
| 2019/0013135 | A1 | 1/2019 | Shirouzu |

FOREIGN PATENT DOCUMENTS

| | | | |
|---|---|---|---|
| CN | 204857392 | U | 12/2015 |
| CN | 106816279 | A | 6/2017 |
| CN | 208521754 | U | 2/2019 |
| DE | 1513862 | A1 | 4/1969 |
| DE | 2521666 | A1 | 12/1975 |
| DE | 202005008057 | U1 | 8/2005 |
| DE | 102016010901 | A1 | 3/2017 |
| FR | 1344403 | A | 11/1963 |
| GB | 1515565 | A | 6/1978 |
| GB | 2001479 | B | 1/1979 |
| JP | 323822 | | 5/1957 |
| JP | 4889330 | A | 11/1973 |
| JP | 50161623 | A | 12/1975 |
| JP | 5453217 | A | 4/1979 |
| JP | 2001292542 | A | 10/2001 |
| JP | 2013128057 | A | 6/2013 |
| JP | 2015033254 | A | 2/2015 |
| JP | 2017059805 | A | 3/2017 |

* cited by examiner

CORE BODY AND REACTOR

CROSS REFERENCE TO RELATED APPLICATIONS

This application is a continuation of U.S. patent application Ser. No. 16/017,191, filed Jun. 25, 2018, that claims benefit of Japanese Patent Application No. 2017-131377, filed Jul. 4, 2017, the disclosures of such applications are incorporated herein by reference.

BACKGROUND OF THE INVENTION

Field of the Invention

The present invention relates to a core body and a reactor including such a core body.

Description Of The Related Art

Reactors include a plurality of iron core coils, and each iron core coil includes an iron core and a coil wound onto the iron core. Predetermined gaps are formed between the plurality of iron cores. Further, in recent years, there are also reactors in which a plurality of iron core coils are arranged inside an outer peripheral iron core (Japanese Unexamined Patent Publication (Kokai) No. 2017-059805).

SUMMARY OF THE INVENTION

The outer peripheral iron cores and iron cores of such reactors are often formed by stacking magnetic plates, such as electromagnetic steel plates, or magnetic foils. In this case, it is necessary to prepare a plurality of magnetic plates or magnetic foils which have been punched to a desired shape. The longer the size of the core body, in particular the length in the stacking direction, and the thinner the magnetic plates or the magnetic foils, the greater the number of stacking steps becomes.

Thus, a core body and a reactor including such a core body for which an increase in labor can be prevented even when the length of the core body in the stacking direction is long are desired.

According to the first aspect of the present disclosure, there is provided a core body comprising an outer peripheral iron core and at least three iron cores inside the outer peripheral iron core and extending in the radial direction thereof, wherein at least one of the outer peripheral iron core and the at least three iron cores are formed of a hoop material wound body formed by winding a hoop material.

In the first aspect, since at least one of the outer peripheral iron core and the at least three iron cores are formed by winding a hoop material, it is not necessary to laminate magnetic plates or the like. Thus, even when the length of the core body in the stacking direction is long, an increase in labor can be prevented. The hoop material is preferably a magnetic plate, for example, an iron plate, a carbon steel plate, or an electromagnetic steel plate, or a magnetic foil.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
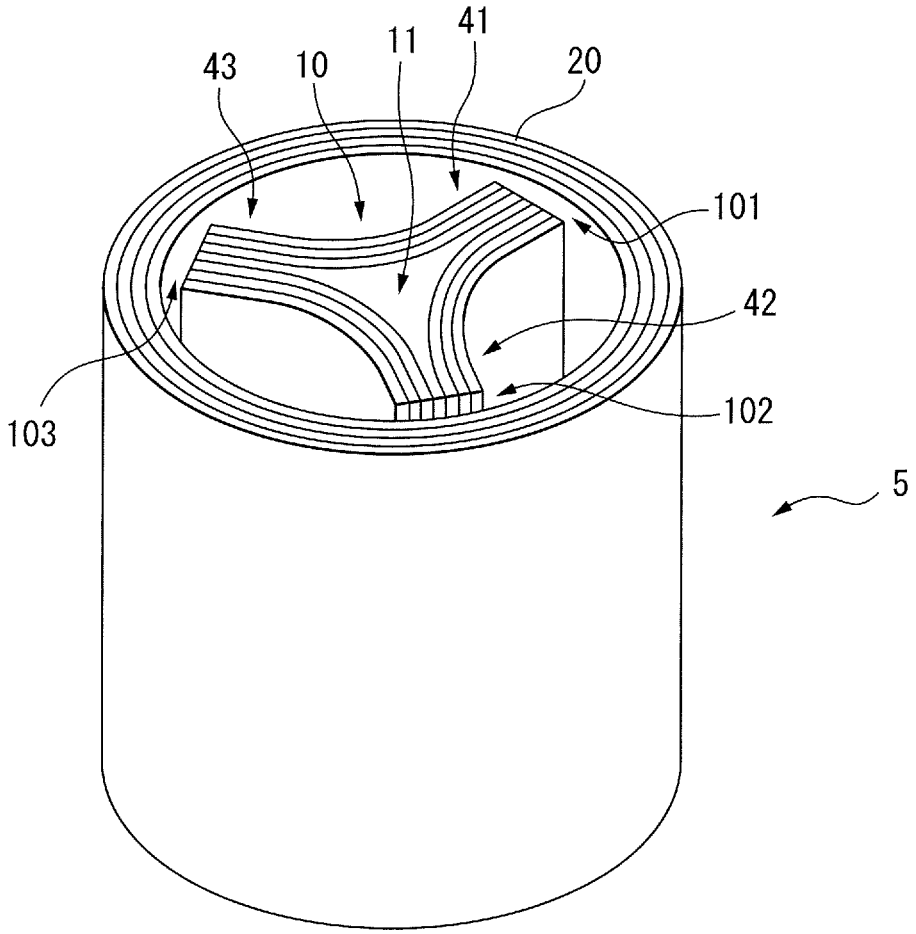
FIG. 1A is a perspective view of a core body according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will mainly be described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

Figure 1B:
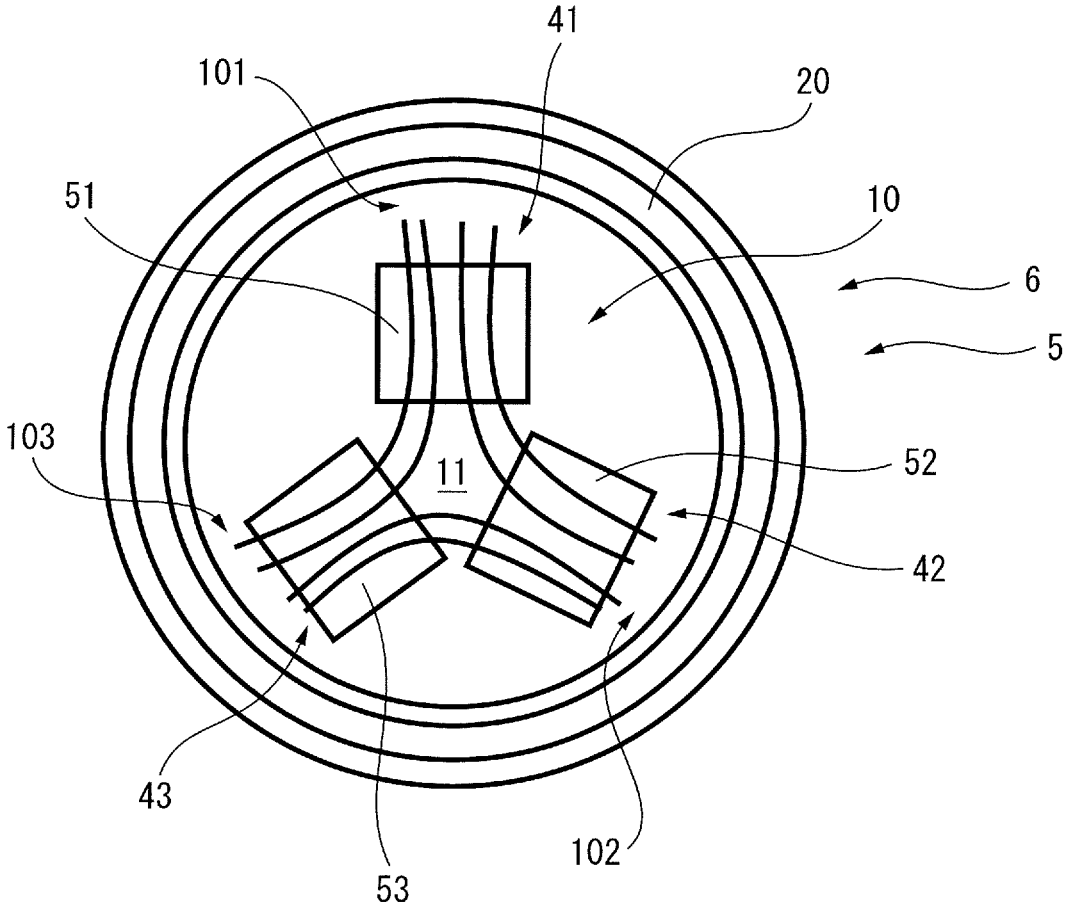
FIG. 1B is a cross-sectional view of a reactor including the core body shown in FIG. 1A.

FIG. 1A is a perspective view of a reactor according to a first embodiment and FIG. 1B is a cross-sectional view of the reactor including the core body shown in FIG. 1A. As shown in FIG. 1A and FIG. 1B, a core body 5 includes a central iron core 10 and an outer peripheral iron core 20 surrounding the central iron core 10. In FIG. 1A, the central iron core 10 is arranged in the center of the annular outer peripheral iron core 20.

As can be understood from the drawing, the central iron core 10 is composed of at least three iron cores 41 to 43 extending in the radial directions. Coils 51 to 53 are wound onto the iron cores 41 to 43, respectively. When a reactor 6 including the core body 5 is used as a three-phase reactor, the number of the iron cores 41 to 43 is preferably a multiple of three. Note that in the drawings described later, illustration of the coils 51 to 53 may be omitted.

As can be understood from FIG. 1A, the outer peripheral iron core 20 may be formed from a cylindrical hoop material wound body formed by winding at least one turn of hoop material. The hoop material is formed by winding, for example, an elongated magnetic plate or magnetic foil into a coil shape. Thus, the hoop material wound body may also be called a magnetic plate wound body. Magnetic plates include iron plates, carbon steel plates, or electromagnetic plates. The same is true for magnetic foils.

The number of windings of the hoop material wound body depends on the required shape of the outer peripheral iron core 20, in particular, the radial thickness thereof and the thickness of the magnetic plate or magnetic foil. The outer peripheral iron core 20 is not limited to the form shown in the drawing. For example, the hoop material wound body may be bent so that the cross-section thereof is a regular polygon.

Figure 2A:
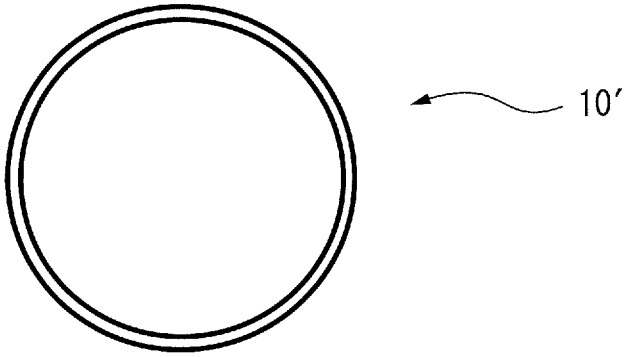
FIG. 2A is a first view detailing the production of a central iron core.
Figure 2B:
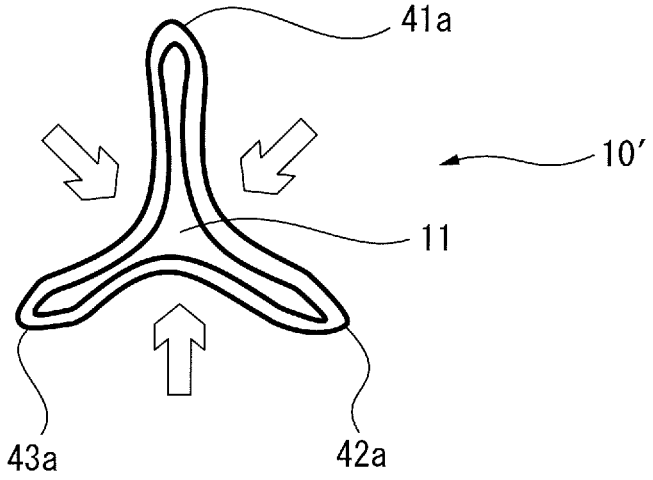
FIG. 2B is a second view detailing the production of the central iron core.
Figure 2C:
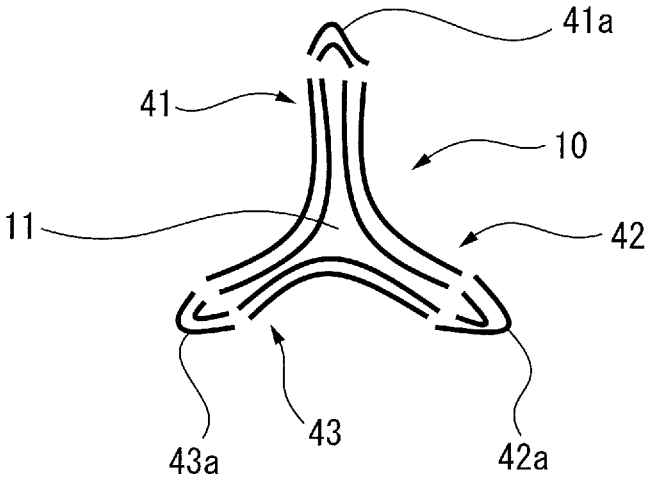
FIG. 2C is a third view detailing the production of the central iron core.

The central iron core 10 may be similarly formed from a hoop material wound body. FIG. 2A through FIG. 2C are views detailing the production of the central iron core. First, a cylindrical hoop material wound body 10' is formed as shown in FIG. 2A by winding a hoop material. For the ease of understanding, the hoop material wound body 10' will be formed from two magnetic plates. The number of windings of the hoop material wound body depends on the required shape of the central iron core 10 and the thicknesses of the magnetic plates or magnetic foils.

Explanation will be continued below, on the basis that the central iron core 10 and the outer peripheral iron core 20 are made from a plurality of magnetic plates, respectively. Furthermore, for the sake of clarity, the plurality of magnetic plates in FIG. 1B and the other drawings may be drawn spaced from each other, but it can be understood that the plurality of magnetic plates actually abut each other as shown in FIG. 1.

Then, at least three areas (three areas in FIG. 2B) of the outer peripheral surface of the hoop material wound body 10' are pressed and bent radially inward as shown in FIG. 2B. The at least three areas are preferably evenly spaced in the circumferential direction of the hoop material wound body 10'. As shown in FIG. 2B, the bent hoop material wound body 10' is deformed into a substantially Y shape having three projection portions 41*a* to 43*a* in which the plurality of magnetic plates contact each other. Note that the bent hoop material wound body 10' does not form a perfect Y shape, and a through-hole 11 may remain in the center thereof.

Thereafter, as shown in FIG. 2C, only the tips of the three projection portions 41*a* to 43*a* are cut. As a result, on the cut surfaces, the cross-sections of the plurality of magnetic plates are exposed in a state in which they are juxtaposed in a direction perpendicular to the axial direction. For example, the projection portion 41*a* is bifurcated at the radially inner side, and each of the bifurcated portions forms one part of the other projection portions 42*a*, 43*a*. The same is true for the other projection portions 42*a*, 43*a*. The three projection portions 41*a* to 43*a* function as the iron cores 41 to 43, respectively.

Referring again to FIG. 1B, the radially outer ends of the iron cores 41 to 43 are spaced from the inside surface of the outer peripheral core 20 by gaps 101 to 103, which can be magnetically coupled. The sizes of the gaps 101 to 103 are preferably equal to each other but may be not equal to each other. By changing the cutting amount of the tips of the projection portions 41*a* to 43*a*, the sizes of the gaps are also changed. Thus, the inductance of the reactor 6 having the core body 5 can be easily changed.

Since the central iron core 10 and/or the outer peripheral iron core 20 of the core body 5 of the first embodiment are formed by winding a hoop material, it is not necessary to stack the magnetic plates or the like. Adjusting the width of the hoop material in advance does not change the labor required to create the core body 5 regardless of the length of the core body 5 in the stacking direction. Therefore, in the first embodiment, it is possible to prevent an increase in the number of steps required to create the core body 5. This is particularly advantageous when the axial length of the core body 5 is large.

Figure 3A:
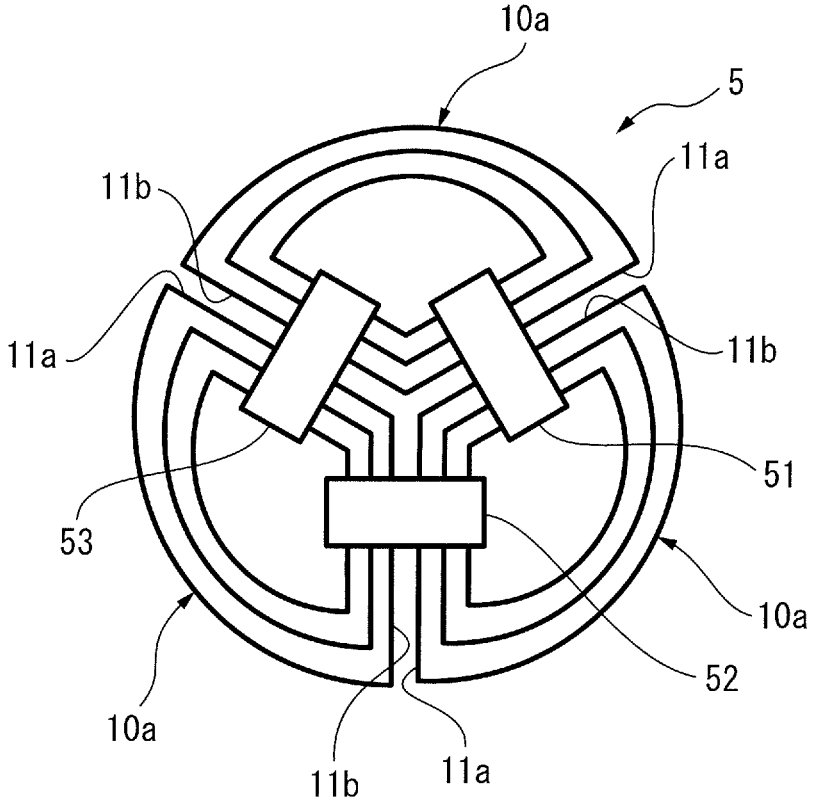
FIG. 3A is a top view of a core body according to a second embodiment.
Figure 3B:
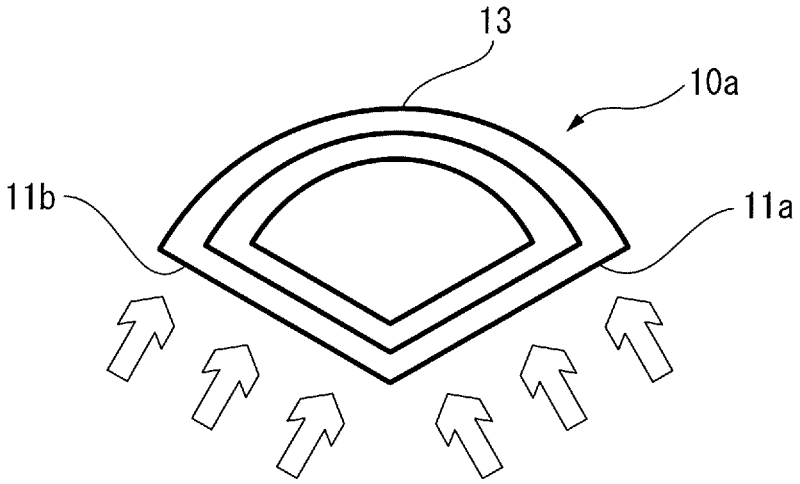
FIG. 3B is an enlarged partial view showing a part of the core body shown in FIG. 3A.

FIG. 3A is a top view of a core body according to a second embodiment and FIG. 3B is an enlarged partial view showing a part of the core body shown in FIG. 3A. The core body 5 of the second embodiment is composed by arranging a plurality of bent hoop material wound bodies 10*a* adjacent to each other in the circumferential direction.

A single hoop material wound body 10*a* is shown in FIG. 3B. Two adjacent portions on the outer peripheral surface of the cylindrical hoop material wound body (refer to FIG. 2A) are pressed and bent over a predetermined length so as to have a predetermined angle. As a result, as shown in FIG. 3B, a substantially fan-shaped hoop material wound body 10*a* having two radius portions 11*a*, 11*b* and an arcuate portion 13 is produced. The predetermined length described above corresponds to the radius of the desired core body 5. The aforementioned predetermined angle is obtained by dividing 360° by the number of iron cores 41 to 43 and are equal to the central angle of the hoop material wound body 10*a*, for example, 120°.

The core body 5 shown in FIG. 3A is produced by arranging at least three hoop material wound bodies 10*a* produced in this manner adjacent to each other. In this case, the at least three arcuate portions 13 correspond to the outer peripheral iron core 20 (refer to FIG. 1A and FIG. 1B) of the core body 5. Further, as can be understood with reference to FIG. 3A and FIG. 1A, the radius portions 11*a*, 11*b*, which are adjacent to each other, correspond to the iron cores 41 to 43 of the core body 5. In the second embodiment, it can be understood that the core body 5 can be easily formed by merely arranging the at least three bent hoop material wound bodies 10*a* adjacent to each other in the circumferential direction.

Figure 3C:
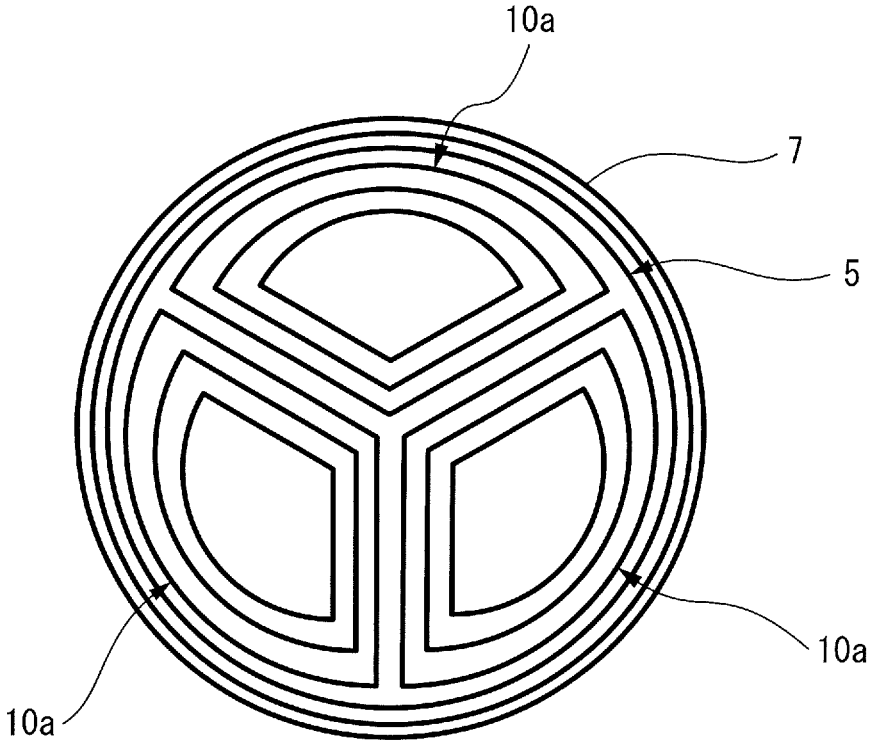
FIG. 3C is another top view of the core body according to the second embodiment.

Further, FIG. 3C is another top view of the core body according to the second embodiment. In FIG. 3C, an additional hoop material wound body 7 is arranged around the core body 5 shown in FIG. 3A. The additional hoop material wound body 7 is preferably formed into a cylindrical shape by winding a hoop material as described above. The inner diameter of the additional hoop material wound body 7 approximately corresponds with the outer diameter of the core body 5. In such a case, after producing the core body 5, the additional hoop material wound body 7 is arranged around the core body 5. As a result, the at least three hoop material wound bodies 10*a* are tightly fixed and can be prevented from being relatively displaced.

Figure 4A:
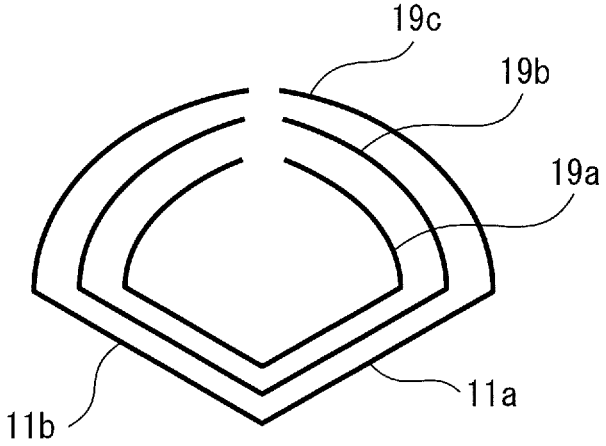
FIG. 4A is a first view detailing the production of a bent hoop material wound body.
Figure 4B:
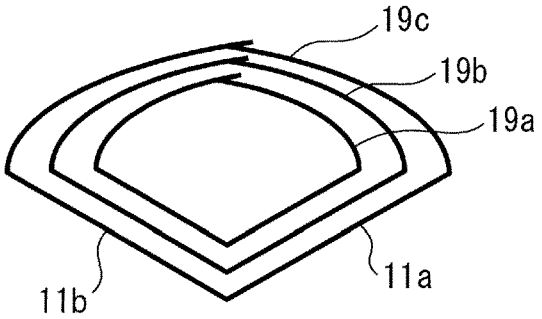
FIG. 4B is a second view detailing the production of the bent hoop material wound body.
Figure 4C:
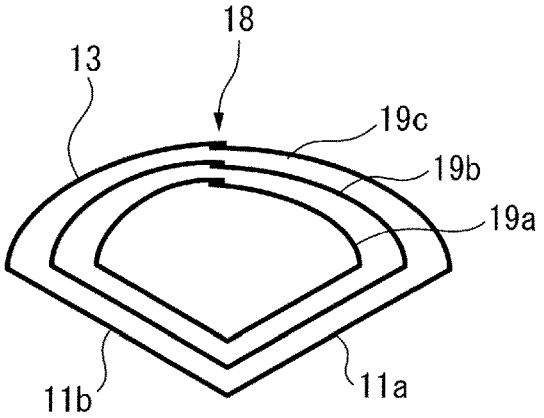
FIG. 4C is a third view detailing the production of the bent hoop material wound body.

The hoop material wound body 10*a* may be produced by a method different from the method described with reference to FIG. 3B. FIG. 4A through FIG. 4C are first to third views detailing the production of a bent hoop material wound body. First, as shown in FIG. 4A, a plurality of magnetic plates 19*a* to 19*c* are cut to predetermined shapes and overlapped with each other. The plurality of magnetic plates 19*a* to 19*c* are bent so as to obtain radius portions 11*a* and 11*b* forming the desired central angle, for example, 120°.

Then, the opposing edges of the plurality of magnetic plates 19*a* to 19*c* are overlapped with each other as shown in FIG. 4B and FIG. 4C. The overlapped edges are joined by lap jointing or step lap jointing to form joint parts 18.

The joint parts 18 may be connected by adhesion, welding or the like as necessary. Note that, as shown in FIG. 4C, the joint parts 18 are preferably arranged in the arcuate portions 13 of the hoop material wound bodies 10*a*. In this case, since the joint parts 18 are not arranged in the radius portions 11*a*, 11*b*, a plurality of hoop material wound bodies 10*a* can be easily assembled with each other as described above.

Further, when forming the core body 5, after arranging a plurality of sets of the plurality of magnetic plates 19*a* to 19*c* in the state shown in FIG. 4A adjacent to each other in the circumferential direction, coils 51 to 53 can be attached to the iron cores 41 to 43. Thereafter, by jointing the joint parts 18, the coils 51 to 53 can be easily mounted.

Figure 5A:
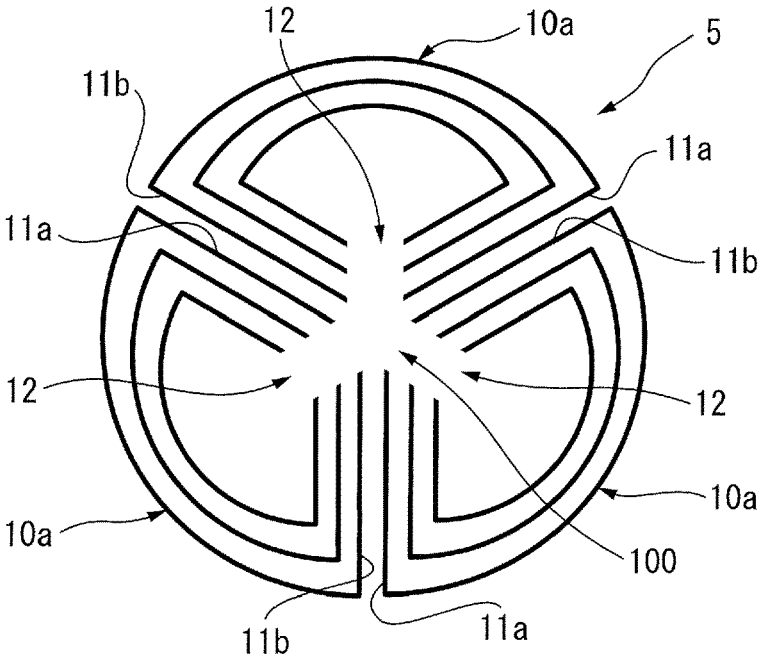
FIG. 5A is a top view of a core body according to a third embodiment.
Figure 5B:
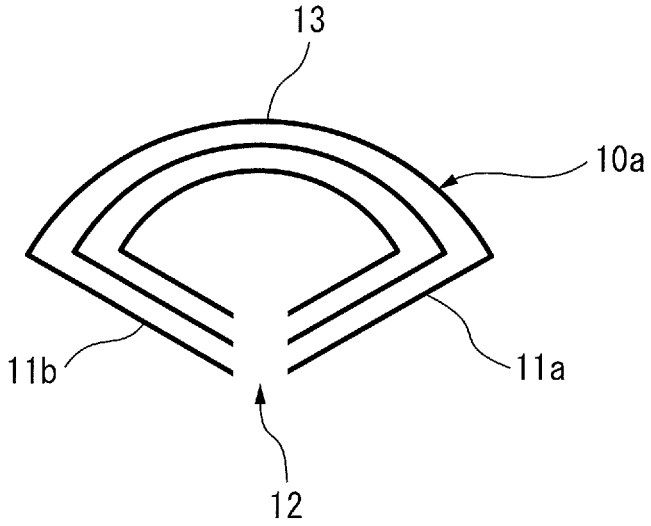
FIG. 5B is an enlarged partial view showing a part of the core body shown in FIG. 5A.
Figure 5C:
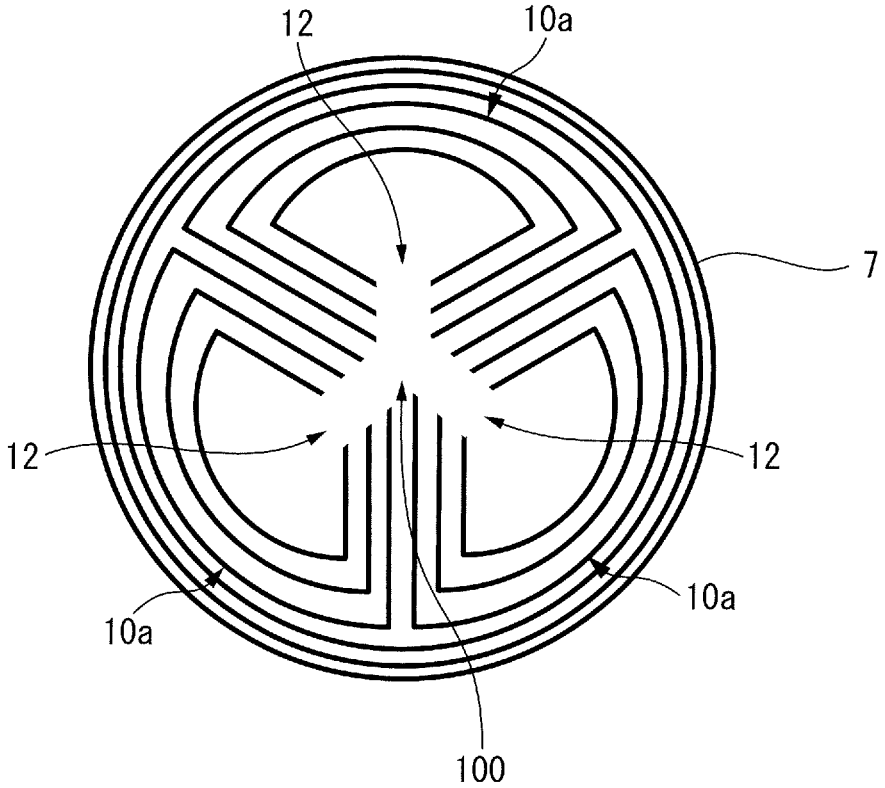
FIG. 5C is another top view of the core body according to the third embodiment.

FIG. 5A is a top view of a core body according to a third embodiment, FIG. 5B is an enlarged partial view showing a part of the core body shown in FIG. 5A, and FIG. 5C is another top view of a core body according to the third embodiment. As described above, in the third embodiment, at least three hoop material wound bodies 10*a* are arranged adjacent to each other as described above to form the core body 5 shown in FIG. 5A.

As shown in FIG. 5B, cutout parts 12 are formed between the radius portions 11*a*, 11*b* of the hoop material wound bodies 10*a*. Therefore, the center of the core body 5 formed from such hoop material wound bodies 10*a* forms an approximately Y-shaped central cutout part 100. The central cutout part 100 may be the gaps, which can be magnetically coupled. In this case, by adjusting the size of the central cutout part 100 or the cutout parts 12, the inductance of a reactor including the core body 5 can be easily adjusted. Further, the additional hoop material wound body 7 may be arranged around the core body 5 as shown in FIG. 5C. In this case, as described above, the at least three hoop material wound bodies 10*a* are tightly fixed and can be prevented from being relatively displaced.

Figure 6:
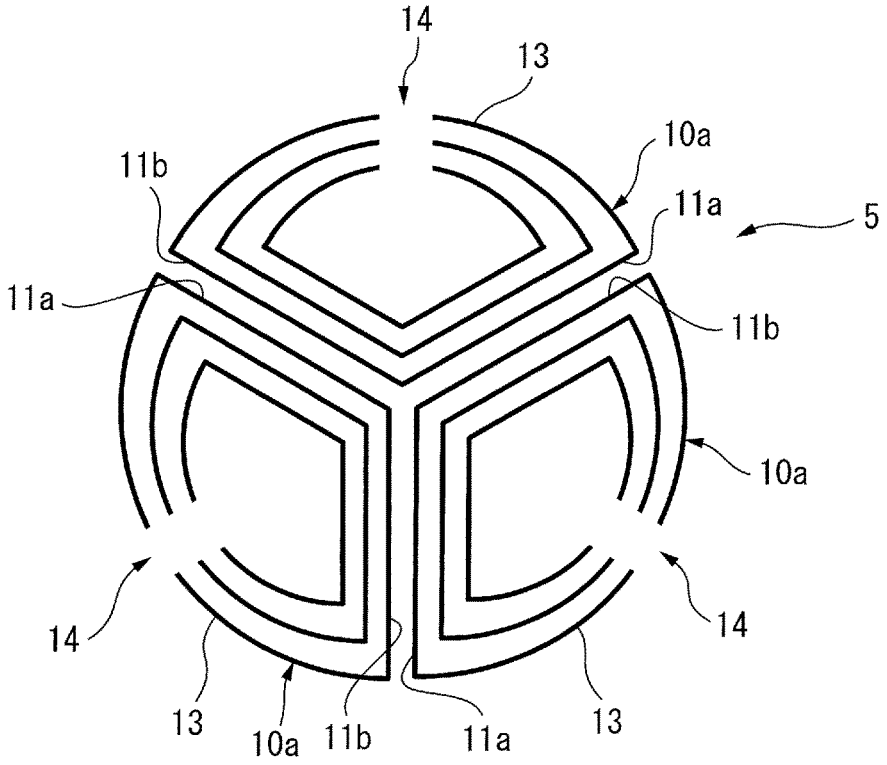
FIG. 6 is a cross-sectional view of a core body according to a fourth embodiment.

FIG. 6 is a cross-sectional view of a core body according to a fourth embodiment. In FIG. 6, outer peripheral cutout parts 14 are formed in the arcuate portions 13 of the plurality of hoop material wound bodies 10*a*, respectively. The outer peripheral cutout parts 14 may be formed by cutting one portion of the arcuate portions 13 after the hoop material wound bodies 10*a* have been formed. Alternatively, as can be understood with Reference to FIG. 4A, the outer peripheral cutout parts 14 may be formed when bending the plurality of magnetic plates 19*a* to 19*c*.

Such outer peripheral cutout parts 14 are preferably arranged at equal intervals in the circumferential direction of the core body 5. The outer peripheral cutout parts 14 may be the gaps, which can be magnetically coupled. In this case, by adjusting the sizes of the outer peripheral cutout parts 14, the inductance of a reactor including the core body 5 can be easily adjusted.

Figure 7:
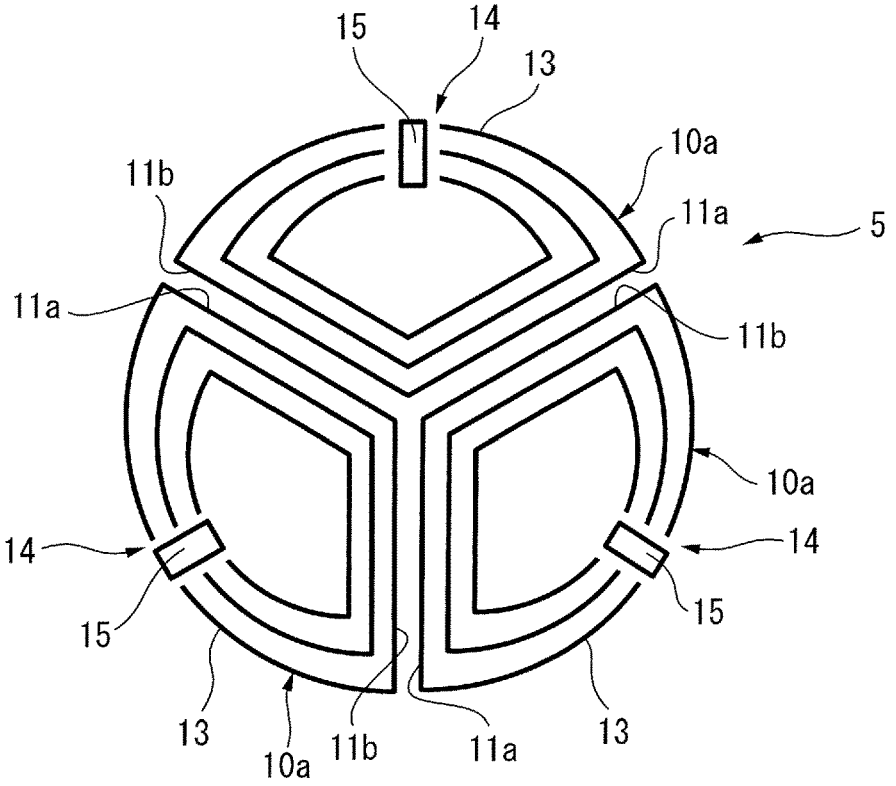
FIG. 7 is a cross-sectional view of a core body according to a fifth embodiment.

Further, FIG. 7 is a cross-sectional view of a core body according to a fifth embodiment. In FIG. 7, additional iron cores 15 are arranged in the outer peripheral cutout parts 14. The cross-sections of the outer peripheral cutout parts 14 and the additional iron cores 15 are rectangular as shown in the drawing. The sizes of the additional iron cores 15 are preferably smaller than the sizes of the outer peripheral cutout parts 14. The additional iron cores 15 are each composed of a single magnetic plate which is thicker than the magnetic plates of which the hoop material wound bodies 10*a* are composed or are formed by stacking a plurality of magnetic plates in the axial direction or the radial direction of the core body 5.

In such a case, gaps are formed between one side of the addition iron cores 15 and one side of the outer peripheral cutout parts 14 and/or between the other side of the addition iron cores 15 and the other side of the outer peripheral cutout parts 14. Such gaps may be the gaps, which can be magnetically coupled. Thus, by adjusting the sizes of the additional iron cores 15, the inductance of a reactor including the core boy 5 can be easily adjusted.

Figure 8A:
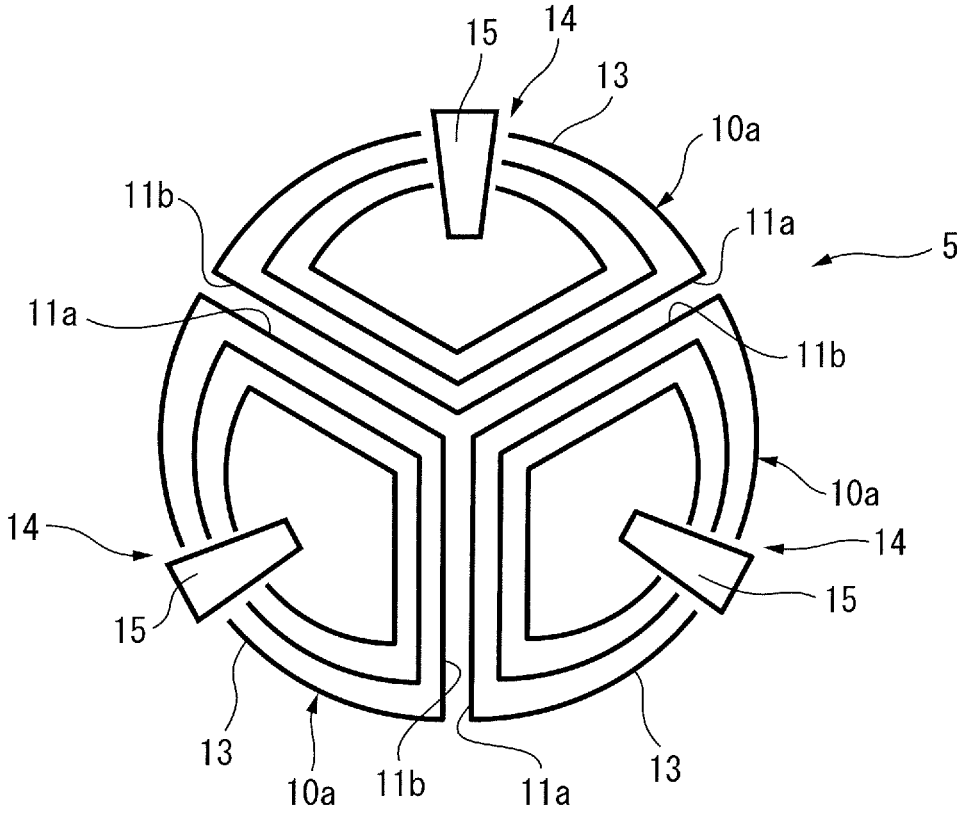
FIG. 8A is a cross-sectional view of a core body according to a sixth embodiment.

Further, FIG. 8A is a cross-sectional view of a core body according to a sixth embodiment. The cross-sections of the outer peripheral cutout parts 14 and the additional iron cores 15 shown in FIG. 8A are trapezoids extending in the radial direction and the tips thereof are arranged radially inward. The lengths of the additional iron cores 15 in the radial direction are preferably larger than the lengths of the outer peripheral cutout parts 14 in the radial direction.

Figure 8B:
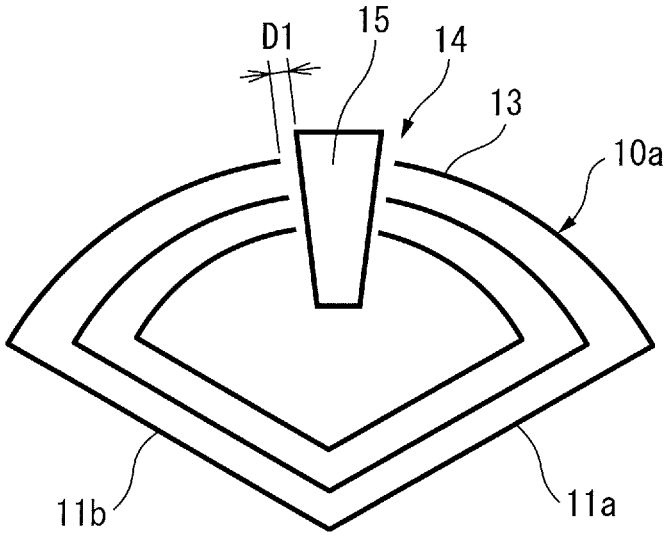
FIG. 8B is an enlarged partial view of the core body shown in FIG. 8A.
Figure 8C:
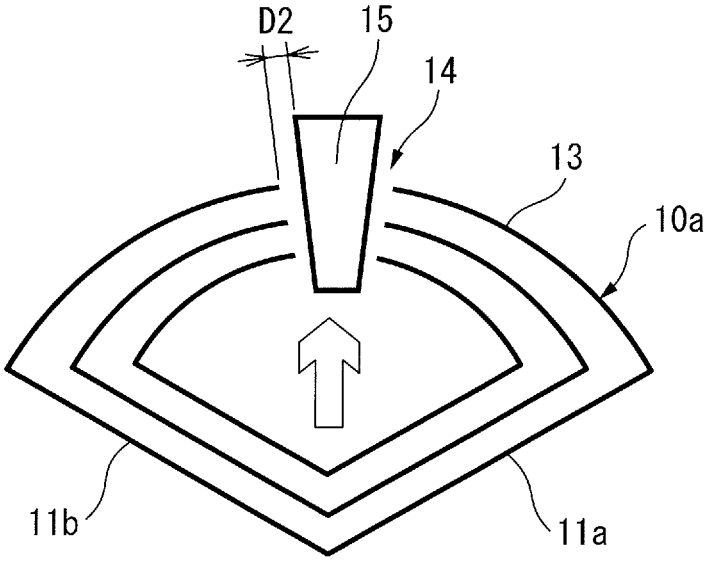
FIG. 8C is another enlarged partial view of a core body.

FIG. 8B and FIG. 8C are enlarged partial views of the core body shown in FIG. 8A. As shown in FIG. 8B, when the radially outward end of the additional iron core 15 is in the vicinity of the arcuate portion 13 of the hoop material wound body 10*a*, a gap having a width D1 is obtained between the outer peripheral cutout part 14 and the additional iron core 15. By moving the additional iron core 15 by a predetermined distance radially outward as shown in FIG. 8C, the width of the gap can be increased to width D2. These gaps can be magnetically coupled.

In other words, in the sixth embodiment, it can be understood that by moving the addition iron cores 15 radially outwardly or inwardly, the sizes of the gaps, which can be magnetically coupled, can be easily changed, and thus, the inductance can be easily adjusted. Note that the cross-section of at least one of the outer peripheral cutout parts 14 and the additional iron cores 15 may be a substantially triangular shape extending in the radial direction.

Figure 9A:
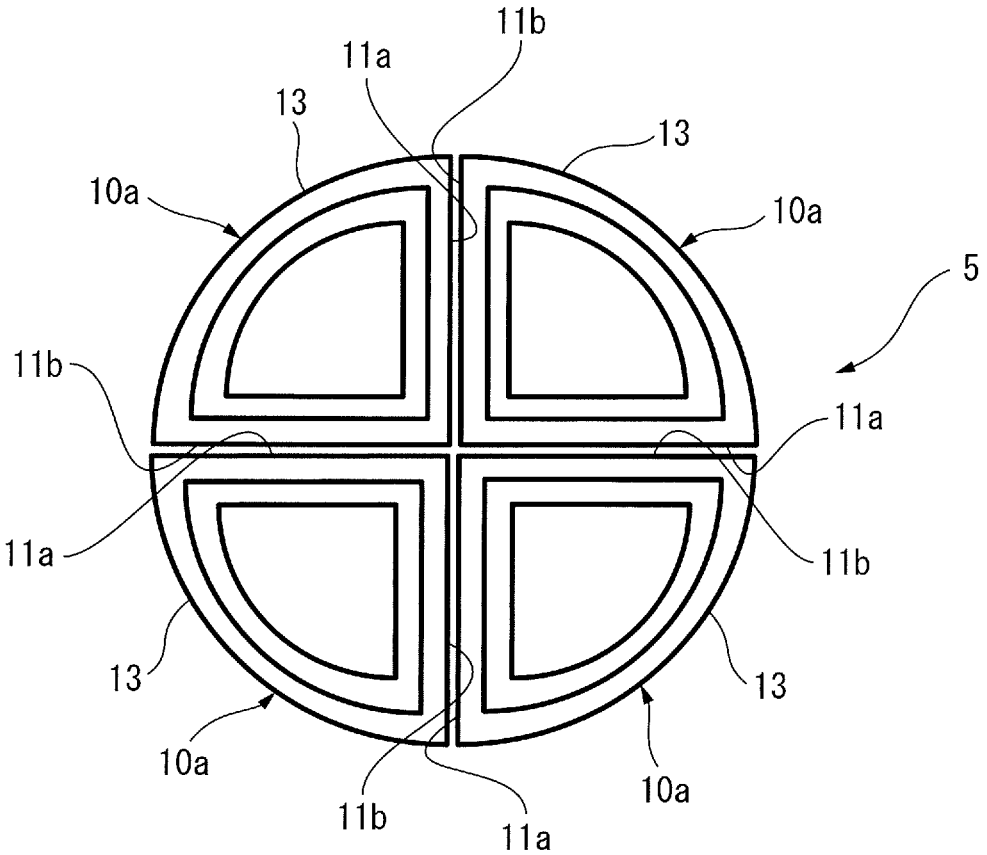
FIG. 9A is a cross-sectional view of a core body according to a seventh embodiment.

FIG. 9A is a cross-sectional view of a core body according to a seventh embodiment. The central angles of the hoop material wound bodies 10*a* shown in FIG. 9A are 90°. Four hoop material wound bodies 10*a* are arranged in contact with each other around the center of the core body 5, whereby the core body 5 is formed. In this case, the four arcuate portions 13 correspond to the outer peripheral iron core 20 (refer to FIG. 1A and FIG. 1B) of the core body 5. Further, as described above, the radius portions 11*a*, 11*b*, which are adjacent to each other, correspond to the iron cores 41 to 44 of the core body 5. Note that the number of the iron cores 41 to 44 is preferably an even number equal to or greater than 4, whereby the reactor 6 including the core body 5 can be used as a single-phase reactor.

Figure 9B:
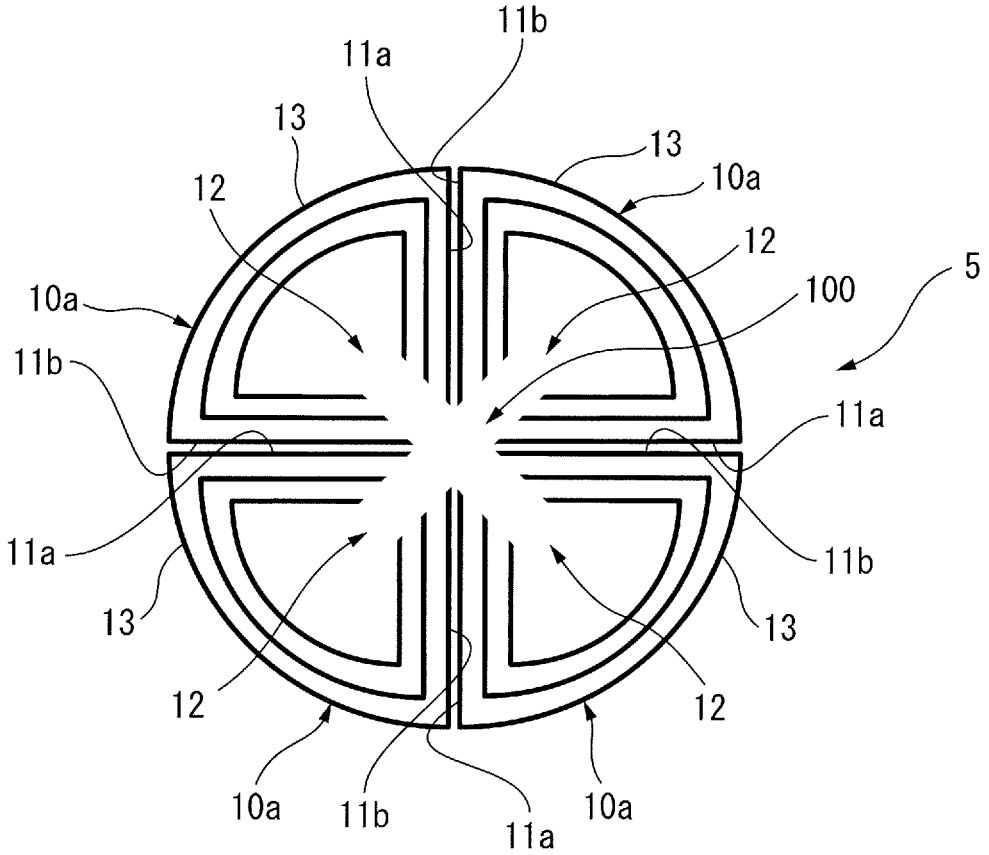
FIG. 9B is a cross-sectional view of another core body according to the seventh embodiment.

Further, FIG. 9B is a cross-sectional view of another core body according to the seventh embodiment. Cutout parts 12 are formed between the radius portions 11*a*, 11*b* of the four hoop material wound bodies 10*a* shown in FIG. 9B. Thus, a substantially X-shaped central cutout part 100 is formed in the center of the core body 5 formed from such hoop material wound bodies 10*a*. The central cutout part 100 may be the gaps, which can be magnetically coupled. In this case, it can be understood that by adjusting the sizes of the cutout parts 12, the inductance of a reactor including the core body 5 can be easily adjusted.

Aspects of the Disclosure

According to the first aspect, there is provided a core body (5), comprising an outer peripheral iron core (20), and at least three iron cores (41 to 43) inside the outer peripheral iron core and extending in the radial direction thereof, wherein at least one of the outer peripheral iron core and the at least three iron cores is formed of a hoop material wound body formed by winding a hoop material.

According to the second aspect, in the first aspect, the at least three iron cores are formed by cutting tips of at least three projecting portions (41*a* to 43*a*) formed by bending at least three portions of an outer peripheral surface of the hoop material wound body inward in the radial direction.

According to the third aspect, in the second aspect, gaps (101 to 103), which can be magnetically coupled, are formed between the tips of the at least three projecting portions and the outer peripheral iron core.

According to the fourth aspect, in the first aspect, the outer peripheral iron core and the at least three iron cores are formed by bending at least three hoop material wound bodies (10*a*) so as to contact each other around the center of the core body.

According to the fifth aspect, in the fourth aspect, the at least three hoop material wound bodies form a central cutout part (100) at the center of the core body.

According to the sixth aspect, in the fourth or fifth aspect, the core body further comprises an additional hoop material wound body (7) surrounding the outer peripheral iron core.

According to the seventh aspect, in any of the fourth through sixth aspects, joint parts (18) of the hoop materials are arranged in one portion of the at least three hoop material wound bodies corresponding to the outer peripheral iron core.

According to the eighth aspect, in the seventh aspect, the joint parts are formed by lap jointing or step lap jointing.

According to the ninth aspect, in any of the fourth through eighth aspects, outer peripheral cutout parts (14) are formed in one portion of each of the at least three hoop material wound bodies corresponding to the outer peripheral iron core.

According to the tenth aspect, in the ninth aspect, the core body comprises additional iron cores (15) inserted in the outer peripheral cutout parts.

According to the eleventh aspect, in the tenth aspect, the cross-sections of the additional iron cores are substantially triangular or substantially trapezoidal.

According to the twelfth aspect, in any of the first through eleventh aspects, the number of the at least three iron cores is a multiple of three.

According to the thirteenth aspect, in any of the first through eleventh aspects, the number of the least three iron cores is an even number not less than four.

According to the fourteenth aspect, there is provided a reactor (6) comprising any of the first through thirteenth core bodies, and coils wound onto the at least three iron cores.

Effects of the Aspects

In the first aspect, since at least one of the outer peripheral iron core and the at least three iron cores is formed by winding a hoop material, it is not necessary to stack magnetic plates or the like. Thus, even when the size of the core body is large, an increase in labor can be prevented. The hoop material is preferably a magnetic plate, for example, an iron plate, a carbon steel plate, or an electromagnetic steel plate, or a magnetic foil.

In the second aspect, by merely bending the hoop material wound body radially inward, the at least three iron cores can be easily formed.

In the third aspect, by changing the cutting amount of the tips of the projection portions, it is easy to change the sizes of the gaps.

In the fourth aspect, by merely assembling at least three bent hoop material wound bodies in the circumferential direction, a core body can be easily formed.

In the fifth aspect, by adjusting the size of the central cutout part, the inductance of a reactor having the core body can be easily adjusted.

In the sixth aspect, the at least three hoop material wound bodies can be tightly fastened.

In the seventh aspect, since the joint parts can be joined after the coils have been attached to the iron cores, the coils can be easily mounted.

In the eighth aspect, the hoop material wound bodies can be easily connected to each other.

In the ninth aspect, by adjusting the size of the outer peripheral cutout parts, the inductance of a reactor having the core body can be easily adjusted.

In the tenth aspect, since the gaps are formed between the additional iron cores and the outer peripheral cutout parts, the inductance of a reactor including the core body can be easily adjusted.

In the eleventh aspect, by moving the additional iron cores radially outwards or inwards, the inductance of a reactor including the core body can be easily adjusted.

In the twelfth aspect, a reactor including the core body can be used as a three-phase reactor.

In the thirteenth aspect, a reactor including the core body can be used as a single-phase reactor.

In the fourteenth aspect, a reactor can be provided with little labor.

Though the present disclosure has been described using representative embodiments, a person skilled in the art would understand that the foregoing modifications and various other modifications, omissions, and additions can be made without departing from the scope of the present disclosure.

The invention claimed is:

1. A core body, comprising:

a central iron core, comprising a single hoop material wound body formed by winding a hoop material, and an outer peripheral iron core surrounding the central iron core, wherein at least three portions of an outer circumferential surface of the hoop material wound body are bent radially inward thereof to form at least three projection portions, and wherein: the at least three projection portions of the central iron core form at least three iron cores, each having a cut tip, which is made by cutting the at least three projection portions of the hoop material wound body, each of the at least three projection portions is located between the at least three portions, and radially outermost ends of the cut tips are spaced apart from an inner surface of the outer peripheral iron core.

2. The core body according to claim 1, wherein gaps, which can be magnetically coupled, are formed between the outer peripheral iron core and the cut tips of the at least three projection portions.

3. The core body according to claim 1, wherein the number of the at least three iron cores is a multiple of 3.

4. The core body according to claim 1, wherein the number of the at least three iron cores is an even number not less than 4.

5. A reactor, comprising the core body according to claim 1, and coils wound onto the at least three iron cores.

* * * * *